US008522395B2

(12) United States Patent
Oh et al.

(10) Patent No.: US 8,522,395 B2
(45) Date of Patent: Sep. 3, 2013

(54) VACUUM CLEANER HAVING SHREDDER

(75) Inventors: Jang-keun Oh, Gwangju (KR); Jun-hwa Lee, Suwon-si (KR); Sung-cheol Lee, Seoul (KR); Jae-jin Aum, Yongin-si (KR); Chang-hyun Park, Gwangju (KR); Jun-hoo Choe, Gwangju (KR); Yong-jae Yong, Anyang-si (KR); Kang Kim, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/362,192

(22) Filed: Jan. 31, 2012

(65) Prior Publication Data

US 2013/0007981 A1 Jan. 10, 2013

(30) Foreign Application Priority Data

Jul. 4, 2011 (KR) ..... 10-2011-0066154

(51) Int. Cl.
*A47L 7/00* (2006.01)

(52) U.S. Cl.
USPC ..... 15/339; 15/347; 15/353

(58) Field of Classification Search
USPC ..... 15/339, 353, 347
IPC ..... A47L 7/00
See application file for complete search history.

(56) References Cited

U.S. PATENT DOCUMENTS

| | | | | |
|---|---|---|---|---|
| 2,105,803 | A * | 1/1938 | Barnes | 56/501 |
| 3,968,938 | A * | 7/1976 | Ruhl et al. | 241/101.1 |
| 4,074,869 | A * | 2/1978 | Johnson | 241/55 |
| 2005/0198770 | A1 * | 9/2005 | Jung et al. | 15/353 |
| 2009/0144932 | A1 | 6/2009 | Yoo | |

FOREIGN PATENT DOCUMENTS

| | | |
|---|---|---|
| EP | 1938735 | 7/2008 |
| JP | 2007-068728 | 3/2007 |

OTHER PUBLICATIONS

Extended European Search Report issued Oct. 17, 2012 in corresponding European Patent Application No. 12157911.4.

* cited by examiner

*Primary Examiner* — David Redding
(74) *Attorney, Agent, or Firm* — Staas & Halsey LLP

(57) ABSTRACT

A vacuum cleaner includes a cleaner body having a suction source for generating a suction force; a suction nozzle assembly to draw in a dust or dirt from a surface to be cleaned by using the suction force of the suction source; a cyclone unit to separate the dust or dirt drawn in through the suction nozzle assembly from an air; a dust bin detachably disposed to the cleaner body to collect the dust or dirt separated at the cyclone unit; and a shredder to shred a paper, the shredder being detachably communicated with an opening of the dust bin to collect the shredded paper into the dust bin.

17 Claims, 11 Drawing Sheets

VACUUM CLEANER HAVING SHREDDER

CROSS-REFERENCE TO RELATED APPLICATIONS

This application claims the benefit under 35 U.S.C. §119 (a) of Korean Patent Application No. 10-2011-066154, filed on Jul. 4, 2011, in the Korean Intellectual Property Office, the entire content of which is hereby incorporated by reference.

BACKGROUND

1. Field

The present disclosure relates to a vacuum cleaner. More particularly, the present disclosure relates to a vacuum cleaner, which draws in and collects a dust or dirt from a surface to be cleaned by using a suction force generated by a suction source.

2. Description of the Related Art

Recently, identity theft due to unwanted leaks of personal information is on a constant rise, and thus the need for security of personal information is being emphasized.

Particularly, personal information such as a person's name, phone number, address, etc. is often listed on bills, receipts, postal matters, etc. sent by mail after credit cards are used. In the case of individuals, however, individuals usually check the contents in the documents and then deposit them intact into a trash bin without separately removing the personal information. If such documents are dumped in a non-shredded state, it is possible that a person's personal information may fall into the hands of others through various routes.

To prevent such unwanted leaks of the personal information through documents deposited in the trash, purchasing and being furnished with a high-priced paper shredder is burden for each individual, so there is a need for an apparatus capable of shredding the documents at low costs and efficiently collecting shredded paper.

SUMMARY

An aspect of the present disclosure is to address at least the above problems and/or disadvantages and to provide at least the advantages described below. Accordingly, an aspect of the present disclosure is to provide a vacuum cleaner, which combines a simple shredding function capable of easily shredding documents (bills, receipts, postal matters, etc.) with a cleaning function, thereby thoroughly preventing unwanted leaks of personal information at low costs without being furnished with a high-priced document shredder, and which can collect shredded paper into a dust bin for collecting a dust or dirt drawn in by the vacuum cleaner.

Additional aspects and/or advantages will be set forth in part in the description which follows and, in part, will be apparent from the description, or may be learned by practice of the invention.

In accordance with an aspect of the present disclosure, a vacuum cleaner includes a cleaner body having a suction source for generating a suction force; a suction nozzle assembly to draw in a dust or dirt from a surface to be cleaned by using the suction force of the suction source; a cyclone unit to separate the dust or dirt drawn in through the suction nozzle assembly from an air; a dust bin detachably disposed to the cleaner body to collect the dust or dirt separated at the cyclone unit; and a shredder to shred a paper, the shredder being detachably communicated with an opening of the dust bin to collect the shredded paper into the dust bin.

The dust bin may include an open and close part to close up the opening thereof during a vacuum cleaning and to open the opening thereof during a use of the shredder.

The open and close part may include a blocking plate slidably coupled to a side of the dust bin to be led in thereinto and withdrawn therefrom; and a guide rib formed on an inner surface of the dust bin to be coupled with an end of the blocking plate thus to maintain a sealing therebetween.

Further, the open and close part may also include a valve rotatably disposed on an inner side of the dust bin; a rotary knob connected to a center of rotation of the valve and exposed to an outer side of the dust bin, to rotate the valve; and a locking protrusion and a pair of fixing protrusions to selectively lock the rotary knob, the locking protrusion being formed on an outer circumferential surface of the rotary knob and the pair of fixing protrusions being formed on the outer side of the dust bin to allow the locking protrusion to be snapped thereto. In this case, it is desirable that the valve includes a pair of wings symmetrical to the center of rotation thereof at both sides thereof, and the pair of wings may have seal members disposed along respective ends thereof to guarantee a sealing performance during the closing up of the opening of the dust bin.

The dust bin may be divided into a first chamber to collect a shredded paper discharged from the shredder and a second chamber to collect the dust or dirt discharged from the cyclone unit. In this case, it is desirable that the dust bin includes first and second outlets to discharge the shredded paper and the dust or dirt collected in the first and the second chambers, respectively, and a discharge cover simultaneously open and close up the first and the second outlets.

The shredder may include a housing having a paper slot formed thereon; a pair of rotary cutters installed in the housing, the pair of rotary cutters being disposed parallel to be engaged with each other thus to shred the paper; a rotary handle to rotate one of the pair of rotary cutters; and a guide installed on an inner side of the housing to guide the paper inserted through the paper slot to portions of the pair of rotary cutters, which are engaged with each other.

The shredder may also include a housing having a paper slot formed thereon; a pair of rotary cutters installed in the housing, the pair of rotary cutters being disposed parallel to be engaged with each other thus to shred the paper; a motor to rotate one of the pair of rotary cutters; a switch installed on an outer side of the housing to turn on and off the motor; and a guide installed on an inner side of the housing to guide the paper inserted through the paper slot to portions of the pair of rotary cutters, which are engaged with each other.

In accordance with another aspect of the present disclosure, a vacuum cleaner includes a cleaner body having an intake port through which a dust or dirt is drawn in from a surface to be cleaned and which is formed on a bottom surface thereof; an impeller rotatably disposed on a suction air path in the cleaner body to drawn in the dust or dirt from the surface to be cleaned through the intake port; a driving motor installed outside the suction air path to drive and rotate the impeller; a dust bin detachably disposed in the cleaner body, the duct bin being disposed in a rear of the impeller to collect the dust or dirt drawn in along the suction air path; and a shredder to shred a paper, the shredder being detachably communicated with an opening of the dust bin to collect the shredded paper into the dust bin.

In accordance with other aspect of the present disclosure, a vacuum cleaner includes a cleaner body having a suction source for generating a suction force; a suction nozzle assembly coupled to or integrally formed with the cleaner body to draw in a dust or dirt from a surface to be cleaned by using the suction force of the suction source; a dust bin to collect the dust or dirt drawn into the dust or dirt through suction nozzle assembly; and a shredder to shred a paper, the shredder being detachably communicated with an opening of the dust bin to collect the shredded paper into the dust bin.

In this case, a suction air path may be formed from the suction nozzle assembly to the suction source, and the dust bin may be disposed on the suction air path between the suction nozzle assembly and the suction source.

It is desirable that the dust bin includes an open and close part to close up the opening thereof during a vacuum cleaning and to open the opening thereof during a use of the shredder.

The dust bin may be also divided into a first chamber to collect the shredded paper discharged from the shredder and a second chamber to collect the dust or dirt discharged from the cyclone unit, and include first and second outlets to discharge the shredded paper and the dust or dirt collected in the first and the second chambers, respectively, and a discharge cover simultaneously open and close up the first and the second outlets.

A suction air path may be formed from the suction nozzle assembly to the suction source, and the dust bin may be disposed in a rear of the suction air path. In this case, it is desirable that the suction source includes an impeller rotatably disposed on the suction air path to drawn in the dust or dirt from the surface to be cleaned through an intake port; and a driving motor installed outside the suction air path to drive and rotate the impeller.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
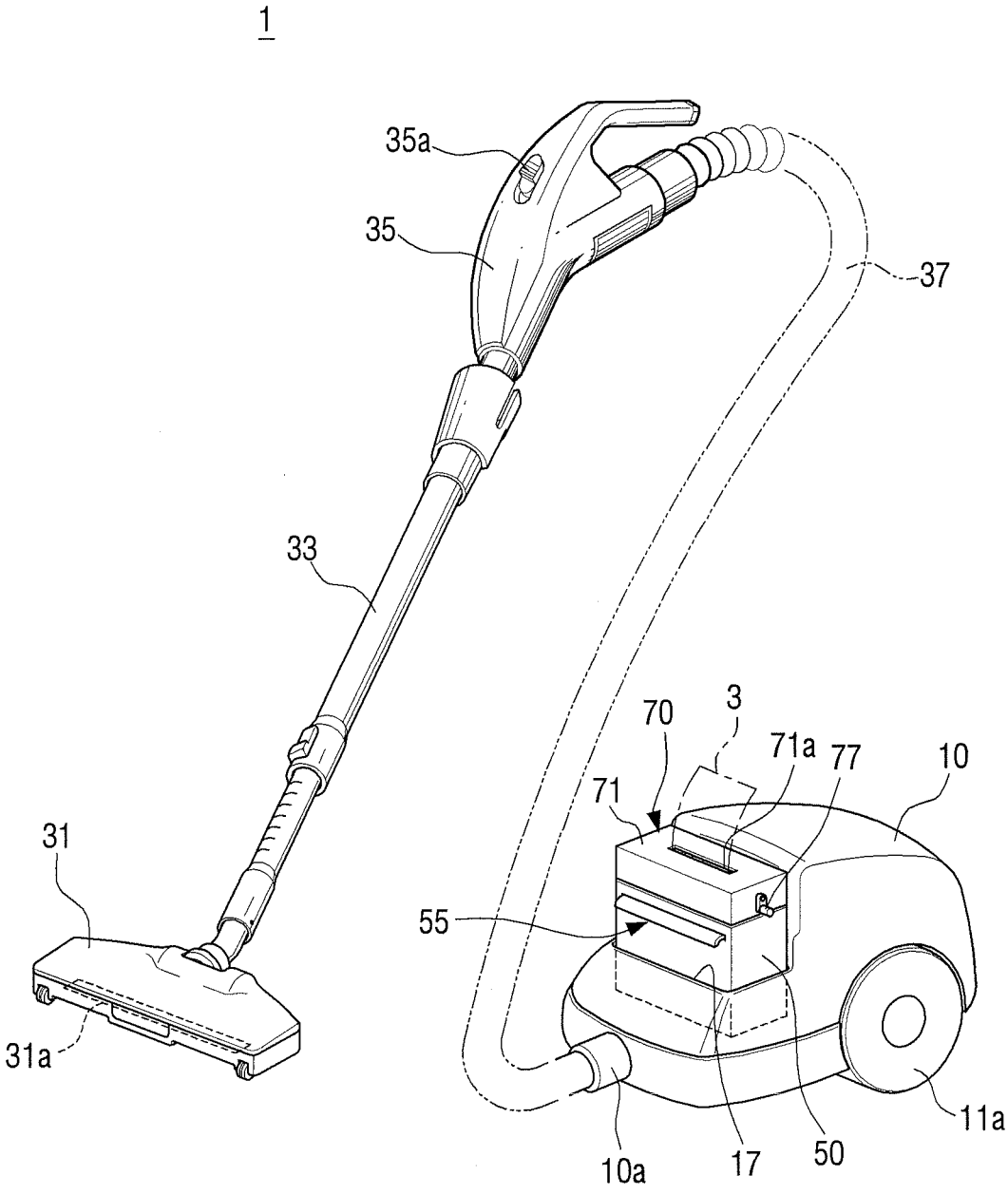
FIG. 1 is a perspective view showing a vacuum cleaner having a shredder according to a first exemplary embodiment of the present disclosure.

Reference will now be made in detail to the embodiments, examples of which are illustrated in the accompanying drawings, wherein like reference numerals refer to the like elements throughout. The embodiments are described below to explain the present invention by referring to the figures.

Hereinafter, a vacuum cleaner having a shredder according to first to third exemplary embodiments of the present disclosure will be described in detail with reference to the accompanying drawing figures.

Referring to FIG. 1, a vacuum cleaner 1 according to a first exemplary embodiment of the present disclosure includes a cleaner body 10, a suction nozzle assembly 31, a dust bin 50 and a shredder 70.

Referring to FIG. 1, the cleaner body 10 has main wheels 11*a* and a subsidiary wheel (not illustrated) disposed on both sides and a front of a bottom surface thereof, respectively, to smoothly move along a surface to be cleaned in a vacuum cleaning.

In addition, the cleaner body 10 has a cyclone unit 13 for separating a dust or dirt D drawn in along with an air from the surface to be cleaned and a suction motor 15 which corresponds to a suction source, contained therein.

In this case, to guide the air laden with the dust D drawn in into the cleaner body 10 to the cyclone unit 13, the cleaner body 10 is provided with a first air passage P1, which connects between a suction port 10*a* installed on a front end thereof and an air inlet 13*a* of the cyclone unit 13. Further, to guide the air from which the dust D is separated at the cyclone unit 13 to the suction motor 15, the cleaner body 10 is provided with a second air passage P2, which connects between an air outlet 13*b* of the cyclone unit 13 and an inlet 15*a* of the suction motor 15.

Referring to FIG. 1, the suction nozzle assembly 31 has an intake port 31*a* formed on a bottom surface thereof facing the surface to be cleaned, and is coupled to and communicated with one end of an extended tube 33 having a telescopic structure to be contractible and extractable. The extended tube 33 and an extension hose 37 are communicated with each other through a handle 35. In this case, the handle 35 has a slide button 35*a* for turning on/off the suction motor 15 and adjusting an intensity of the suction force installed on one surface thereof. The extension hose 37, the one end of which is communicated with the handle 35, has the other end communicated with the suction port 10*a* of the cleaner body 10.

According to this, the air laden with the dust D drawn in into the intake port 31*a* of the suction nozzle assembly 31 successively passes through the extended tube 33, the inside of the handle 35 and the extension hose 37 and then flows into the first air passage P1 in the cleaner body 10.

Figure 2:
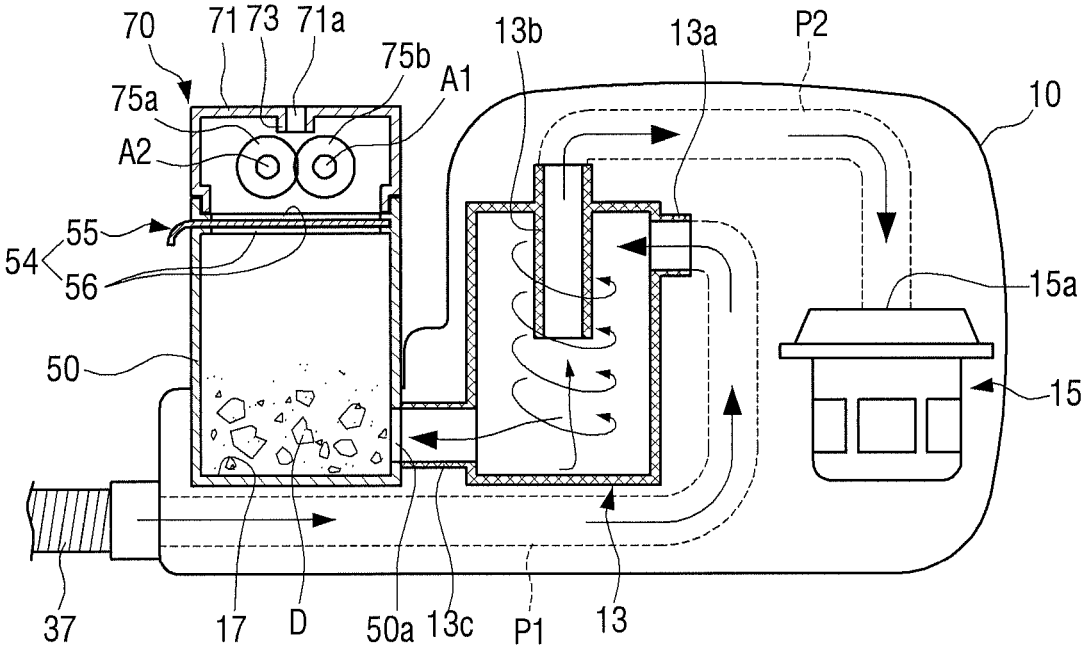
FIG. 2 is a schematic cross-sectional view showing an inner structure of the vacuum cleaner having the shredder according to the first exemplary embodiment of the present disclosure.

Referring to FIG. 2, the dust bin 50 is detachably coupled into an accommodating recess 17 formed on the cleaner body 10. In this case, on a side surface of the accommodating recess 17 is installed a dust discharging port 13*c* for discharging the dust D from the cyclone unit 13. The dust discharging port 13*c* at one end thereof is communicated with a lower side of the cyclone unit 13, and at the other end thereof is communicated with a dust inlet 50*a* formed on one surface of the dust bin 50 when the dust bin 50 is mounted in the accommodating recess 17 of the cleaner body 10.

Figure 3:
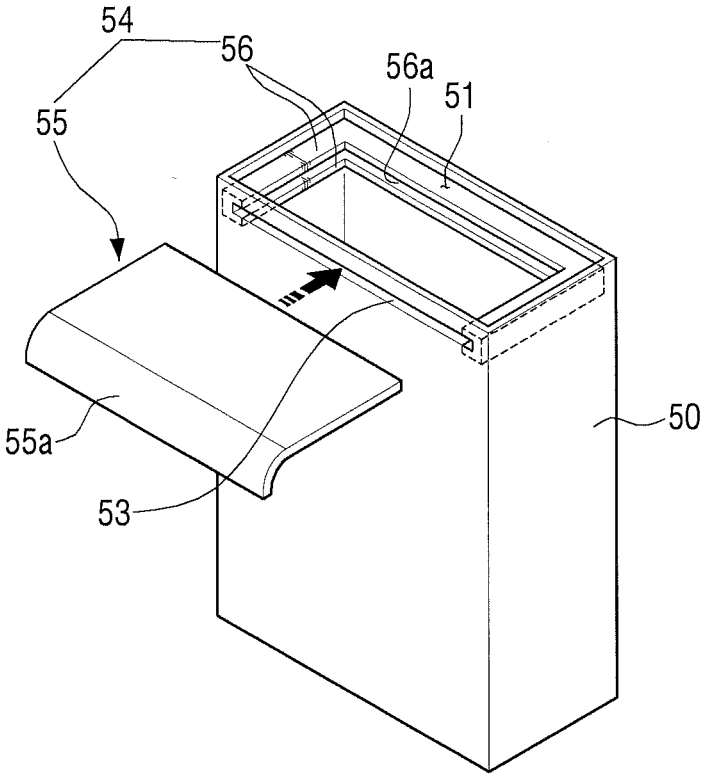
FIG. 3 is a perspective view showing a sealing structure using a blocking plate in a dust bin shown in FIG. 2.

Referring to FIG. 3, the dust bin 50 is formed in a rectangular tub form having an opening 51 formed at an upper part thereof. The dust bin 50 at one surface thereof has an inserting hole 53 formed, so that a blocking plate 55 is slidably inserted thereinto.

In addition, to collect shredded paper 3 (see FIG. 1) supplied from the shredder 70 installed in the opening 51, the dust bin 50 is maintained in such a state that it is communicated with a lower part of the shredder 70. In this case, since the shredder 70 at the paper slot 71*a* for inserting a paper 3 is always opened, the dust bin 50 at the inside thereof is maintained at an atmospheric pressure. Like this, if the dust bin 50 at the inside thereof is in a state of such an atmospheric pressure, there is a problem in that during the vacuum cleaning, the vacuum cleaner at the air path from the suction nozzle assembly 31 to the suction motor 15 is not maintained well in a vacuum state. To address the problem, the dust bin 50 has an open and close part 54, which closes up the opening 51 thereof during the vacuum cleaning and opens the opening 51 thereof during the use of the shredder 70.

The open and close part 54 includes a blocking plate 55 capable of being led in into and withdrawn from the inserting hole 53 of the dust bin 50, and a pair of guide ribs 56 coupled with the blocking plate 55 to be capable of maintaining a sealing therebetween.

The blocking plate 55 is contoured corresponding to a shape of the dust bin 50, and to allow a user to easily lead in and withdraw the blocking plate 55, has one side end 55*a* projected to the outside of the dust bin 50 and bent downward.

The pair of guide ribs 56 are continuously formed in a parallel spaced-apart relation to each other along an inner surface of the dust bin 50 to form a coupling groove 56*a*. In this case, the coupling groove 56*a* is formed to have a width or height equal to or smaller than a thickness of the blocking plate 55, so that an end of the blocking plate 55 is tightly coupled thereto.

At this time, it is desirable that to increase a sealing performance between the blocking plate 55 and the guide ribs 56, a seal member (not shown) is disposed along the coupling groove 56*a*, and a seal member (not shown) is also disposed on an inner side of the inserting hole 53 of the dust bin 50 through which the blocking plate 55 passes.

Figure 4:
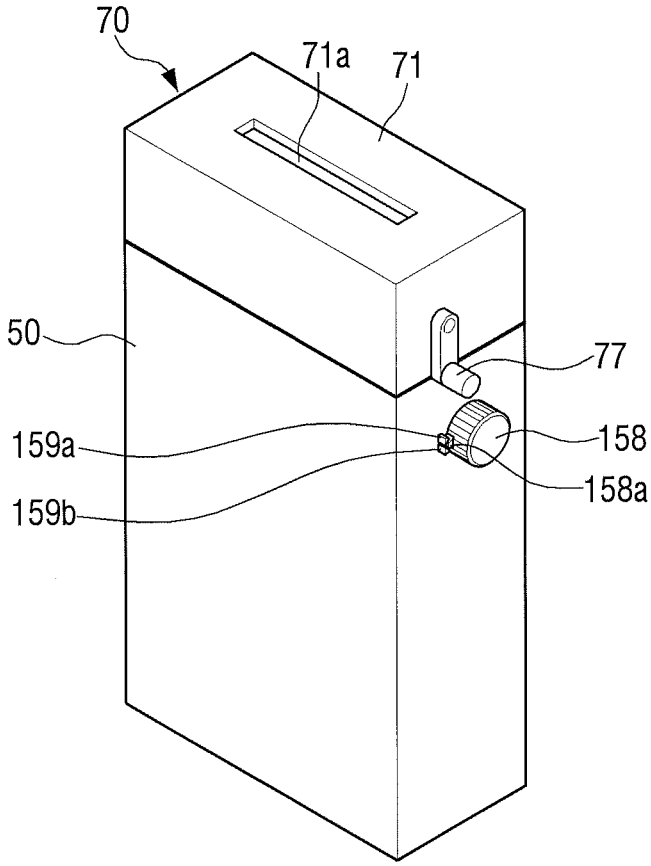
FIG. 4 is a perspective view showing another example (a sealing structure using a valve) of the dust bin.
Figure 5:
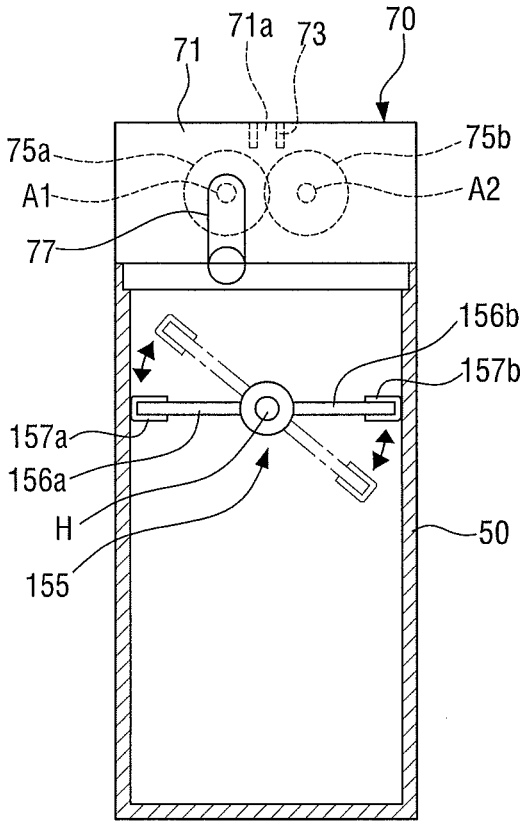
FIG. 5 is a schematic cross-sectional view showing the inside of the dust bin shown in FIG. 4.
Figure 6:
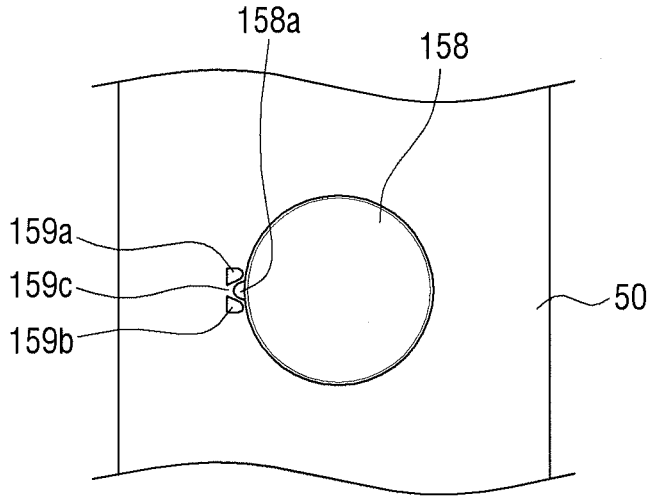
FIG. 6 is a side elevation showing a locking structure of a rotary knob shown in FIG. 4.

Of course, instead of the open and close part 54, the dust bin 50 may have a valve type open and close part 155 as shown in FIGS. 4 to 6.

Referring to FIG. 5, the open and close part is provided with a valve 155, which is rotatably and pivotally disposed on a hinge axis H in the dust bin 50. In this case, to open and close up the opening 51 of the dust bin 50, the valve 155 has a pair of wings 156*a* and 156*b* symmetrically formed to a center of rotation thereof at both sides thereof. At this time, the pair of wings 156*a* and 156*b* at ends thereof come in contact with the inner surface of the dust bin 50, and by disposing seal members 157*a* and 157*b* along the ends of the pair of wings 156*a* and 156*b*, a sealing performance during the closing up of the opening 51 of the dust bin 50 can be improved.

Referring to FIG. 6, the open and close part includes a rotary knob 158, which is exposed to the outside of the dust bin 50 to allow the user to rotate the valve 155, The rotary knob 158 is connected to the hinge axis H, so that it can rotate the valve 155 in one direction and the other direction to open and close up the opening 51 of the dust bin 50.

In this case, to maintain the valve 155 in a closed-up state, a locking protrusion 158*a* for locking the rotary knob 158 is formed on an outer circumferential surface of the rotary knob 158, and a pair of fixing protrusions 159*a* and 159*b* to which the locking protrusion 158*a* is snapped are formed on an outer side surface of the dust bin 50.

The pair of fixing protrusions 159*a* and 159*b* are located at positions corresponding to angles of the pair of the wings 156*a* and 156*b* where they close up the opening 51 of the dust bin 50. In this case, the pair of fixing protrusions 159*a* and 159*b* are formed in a spaced-apart relation to each other to form a locking groove 159*c* into which the locking protrusion 158*a* is locked.

The shredder 70, which is for shredding the paper, such as receipts or the like, is installed to be communicated with the opening 51 formed on the upper part of the dust bin 50. In this case, as the shredder 70 is installed on the dust bin 50, shredded paper is naturally collected into the dust bin 50 by its own weight.

The shredder 70 as describe above may be configured in a manual type or an automatic type. First, an example of the shredder 70 configured in the manual type will be explained.

Referring to FIGS. 2 and 5, the shredder 70 includes a housing 71, a pair of rotary cutters 75*a* and 75*b*, and a rotary handle 77.

The housing 71 has a paper slot 71*a* formed at an upper surface thereof to insert the paper thereinto, and at a lower part thereof is opened to allow the shredded paper to fall down into the dust bin 50. In this case, it is desirable that at coupled portions (a lower end of the housing 71 and an upper end of the opening 51 of the dust bin 50) between the housing 71 and the dust bin 50, a seal member (not shown) is disposed to maintain a sealing therebetween.

Further, the housing 71 has guide protrusions 73 formed to be extended along a lower end of the paper slot 71*a*. The guide protrusions 73 guides to move a front end of the paper 3 inserted through the paper slot 71*a* to portions of the pair of the rotary cutters 75*a* and 75*b*, which are engaged with each other.

The pair of the rotary cutters 75*a* and 75*b* are rotatably installed in the housing 71, and have blade parts 176*a* and 176*b* (see FIG. 8) formed in a circumferential direction in a spaced-apart relation to each other on circumferential surfaces thereof to shred the paper 3 inserted into the housing 71 through the paper slot 71*a*. In this case, the pair of the rotary cutters 75*a* and 75*b* are disposed to be engaged in a parallel state with each other (to be specific, to alternately cross blade parts 176*a* and 176*b* thereof to each other). Accordingly, the paper, which passes through the pair of the rotary cutters 75*a* and 75*b*, is shredded into a plurality of paper strips with thin width.

Also, it is desirable that the pair of the rotary cutters 75*a* and 75*b* have gears (not shown) installed to engaged with each other on one ends of rotation axes A1 and A2 thereof, so that when one thereof is rotated in a forward direction, the other thereof is rotated in a reverse direction.

The rotary handle 77 is connected to the rotation axis A1 of any one 75*a* of the pair of rotary cutters 75*a* and 75*b*. In this case, the rotary handle 77 is exposed to the outside of the housing 71, so that it can be manipulated by the user.

A method of using the shredder 70 as constructed above is as follows. First, before the shredder 70 is used, the opening 51 of the dust bin 50 is opened by the open and close part 54 or 155. After that, a user inserts into the paper slot 71*a* with one hand and at the same time, rotates the rotary handle 77 with the other hand. As a result, the paper can be shredded.

Figure 7:
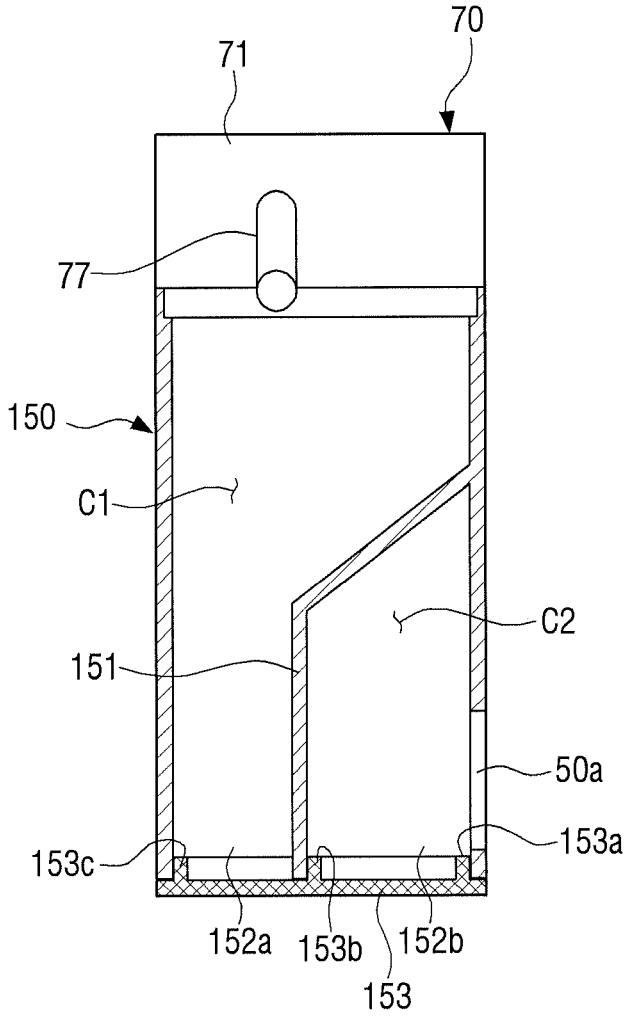
FIG. 7 is a perspective view showing other example (a structure divided into first and second chambers) of the dust bin.

Referring to FIG. 7, a dust bin 150 may be configured to have a partition plate 151, which divides it into a first chamber C1 for collecting the shredded paper discharged form shredder 70 and a second chamber C2 for collecting the dust discharged from the cyclone unit 13. In this case, the shredded paper and the dust collected in the first and the second chambers C1 and C2 are discharged through first and second outlets 152*a* and 152*b* on the lower part of the dust bin 150.

The first and second outlets 152*a* and 152*b* are simultaneously opened and closed up by a discharge cover 153. In this case, the discharge cover 153 has first to third coupling protrusions 153*a*, 153*b* and 153*c* formed to be detachably connected to the first and the second outlets 152*a* and 152*b*. At this time, a seal member (not shown) may be disposed on outer sides of the first and the second coupling protrusions 153*a* and 153*b* to maintain a sealing performance to the second chamber C2.

If the dust bin 150, the inside of which is divided by the partition plate 151, is applied, the open and close part 54 or 155 may be omitted because the second chamber C2 is maintained in a closed-up state by the discharge cover 153.

Figure 8:
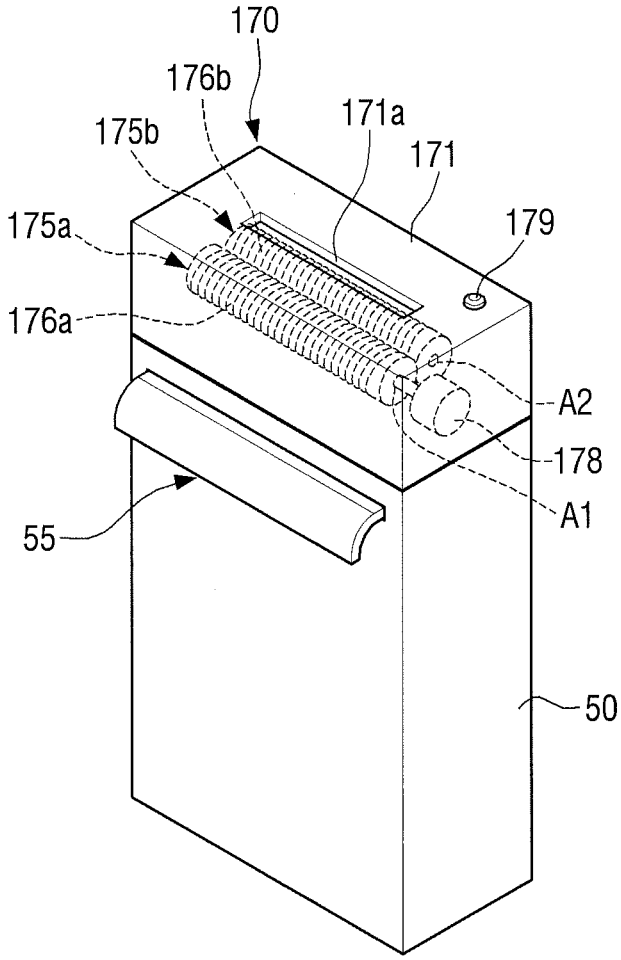
FIG. 8 is a perspective view showing another example (a traditional shredding type) of the shredder.

Referring to FIG. 8, the present disclosure, of course, may employ an automatic type shredder 170 besides the manual type shredder 70 as described above.

Like the manual type shredder 70, the automatic type shredder 170 includes a housing 171, a paper slot 171*a*, guide protrusions (not shown) and a pair of rotary cutters 175*a* and 175*b*.

Also, the shredder 170 further includes a motor 178 connected to the rotation axis A1 of the rotary cutter 175*a* to rotate any one of the pair of rotary cutters 175*a* and 175*b*, and an operation button 179 for turning on and off the motor 178. In this case, the operation button 179 is electrically connected to a circuit part (not shown) for applying an electric power to the motor 178, and is disposed in a certain position on the outer side of the housing 171, so that it can be manipulated by the user.

A method of using the shredder 170 as constructed above is as follows. First, the opening 51 of the dust bin 50 is opened by the open and close part 54 or 155. And then, in a state where the operation button 179 is pushed by a user to turn on the motor 178, a paper is inserted into the paper slot 71*a* by one hand of user. As a result, the paper is shredded through the rotary cutters 175 and 175*b* rotated by the motor 178 and then collected into the dust bin 50.

In this case, according to designs of the circuit part, the shredder 170, of course, may be configured to be operated in such a semi-automatic manner that the rotary cutters 175*a* and 175*b* are driven only in a state where the operation button 179 are pushing by the user.

A construction of ah upright type vacuum cleaner 1*a* in which a shredder 270 is installed, according to a second exemplary embodiment of the present disclosure will be explained with reference to FIGS. 9 and 10.

Like the canister type vacuum cleaner 1 as described above, the upright type vacuum cleaner 1*a* has a cyclone unit and a suction motor contained in a cleaner body 210. In the upright type vacuum cleaner 1*a* according to the second exemplary embodiment of the present disclosure, however, a dust bin 250 and a shredder 270 are mounted in the cleaner body 210, so that they are not completely exposed to the outside of the cleaner body 210, but only a portion thereof is exposed to the outside of the cleaner body 210, unlike the canister type vacuum cleaner 1.

It is desirable that in view of the fact that only the portion of the dust bin 250 is exposed, an open and close part 254, which opens and closes up an opening of a dust bin 250 by using a blocking plate 255 and guide ribs 256, is applied.

Further, it is desirable that the shredder 270 is formed in the same construction as that of the automatic type shredder 170 rather than the manual type shredder 70. However, in view of the fact that a housing 271 of the shredder 270 at a front hereof is exposed, a paper slot 271*a* and an operation button 279 are formed in the front of the housing 271 as shown in FIG. 9 and guide protrusions 273 are disposed to guide the paper from the paper slot 271*a* to portions of a pair of rotary cutters 275*a* and 275*b*, which are engaged with each other.

Figure 9:
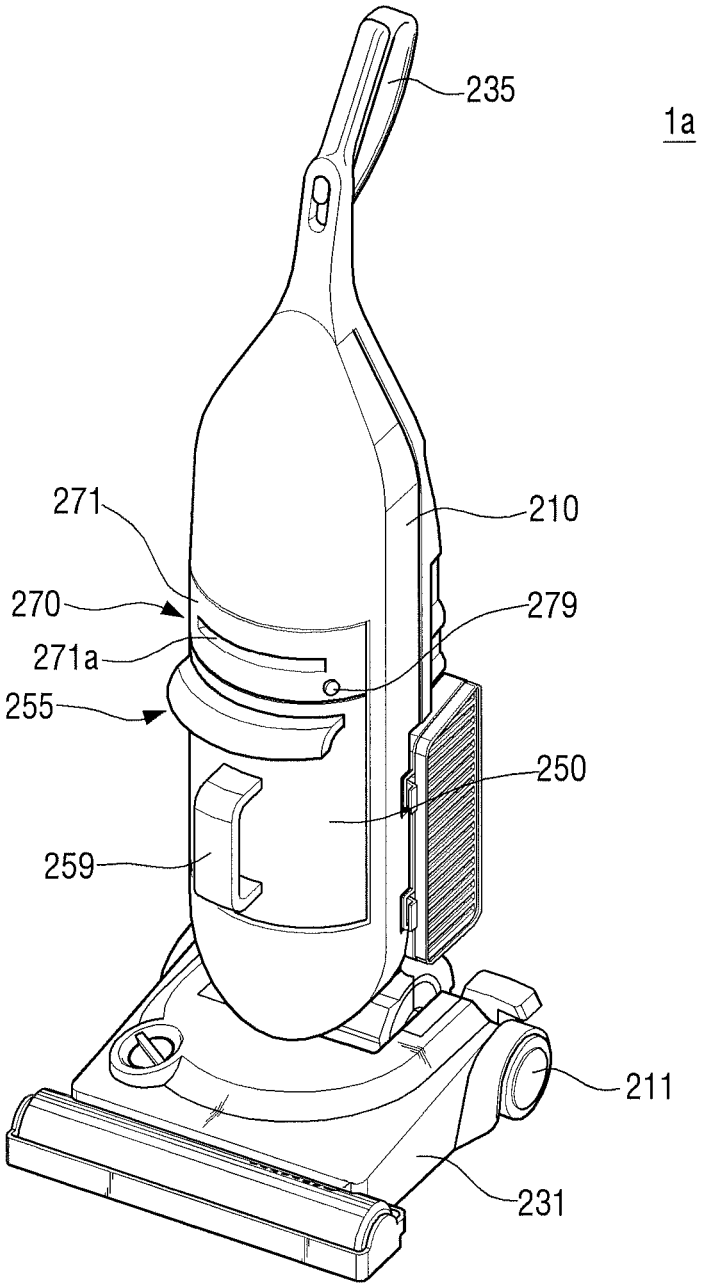
FIG. 9 is a perspective view showing a vacuum cleaner having a shredder according to a second exemplary embodiment of the present disclosure.
Figure 10:
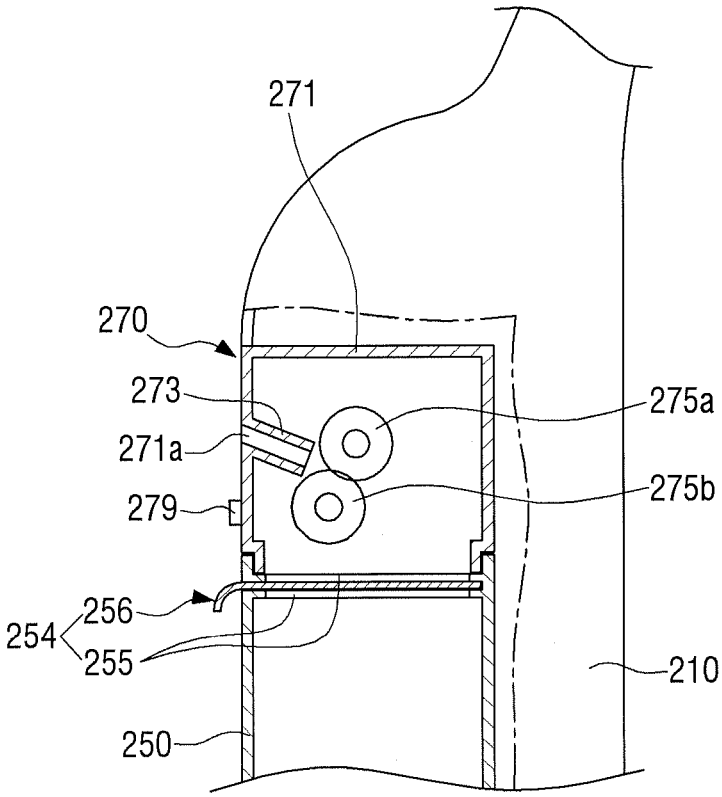
FIG. 10 is a schematic cross-sectional view showing a shredder and a dust bin shown in FIG. 9.

In FIG. 9, non-explained numerals 211, 231, 235 and 259 designate wheels installed at both sides of a cleaner body 210, a suction nozzle assembly hinged and connected to a lower end of the cleaner body 210 to be able to communicated therewith, a handle for moving the cleaner body 210, and a withdrawal handle for withdrawing the dust bin 250 from the cleaner body 210, respectively.

A construction of a robot cleaner 1*b* in which a shredder 370 is installed, according to a third exemplary embodiment of the present disclosure will be explained with reference to FIG. 11.

The robot cleaner 1*b* according to the third exemplary embodiment of the present disclosure is configured, so that an intake port 311 facing the surface to be cleaned, is formed on a bottom surface of a cleaner body 310, and a suction source for drawing in the dust or dirt, for example, an impeller 379 and a driving motor 378, are disposed on a suction air path P (that is, P3, P4, and P5) from the intake port 311 to a dust bin 350.

The impeller 379 is rotated receiving a rotation force from the driving motor 378, and is disposed between the intake port 311 and the dust bin 350. Like this, if the impeller 379 is used, a portion from the intake port 311 to a chamber 313 in which the impeller 379 is installed among the suction path P is maintained in a vacuum state.

Accordingly, since in the robot cleaner 1*b* according to the third exemplary embodiment of the present disclosure, the dust bin 350 is installed in the rear of the impeller 379, it functions even if the dust bin 350 at the inside thereof is not maintained in a vacuum state. Thus, in the dust bin 350, the open and close part 54, 155 or 254 of as explained in the vacuum cleaners of the first and the second exemplary embodiment of the present disclosure can be omitted.

The shredder 370 applied to the robot cleaner 1*b* according to the third exemplary embodiment of the present disclosure may employ the manual type shredder 70 (see FIG. 5) as described above, but it preferably employs the automatic type shredder 170 (see FIG. 7) as described above to allow a portion of the shredder 370 to be embedded in the cleaner body 310, thereby compactly maintaining the robot cleaner 1*b* in entire size.

Figure 11:
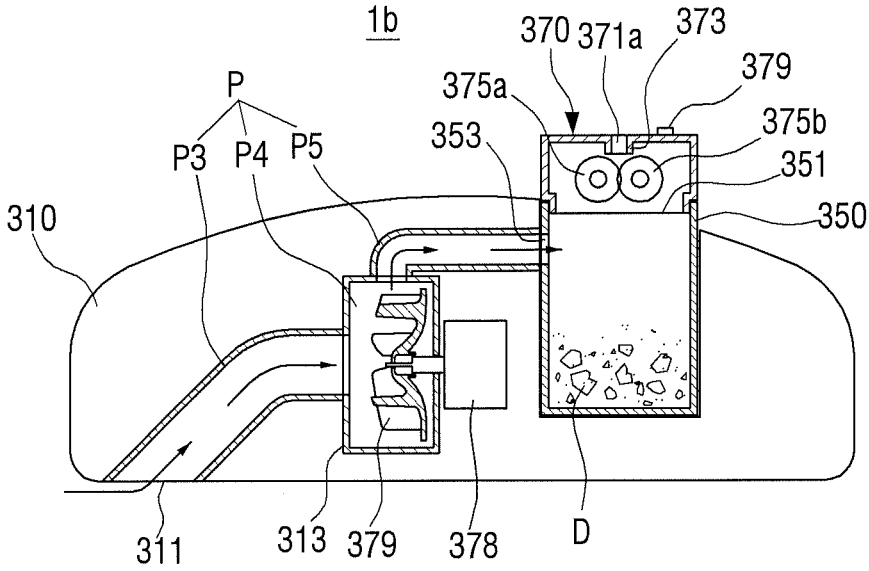
FIG. 11 is a perspective view showing a vacuum cleaner having a shredder according to a third exemplary embodiment of the present disclosure.

In FIG. 11, non-explained numerals 351, 353, 371, 371*a*, 373, 375*a* and 375*b*, 379, and D designate an opening of the dust bin, a dust inlet for taking a dust or dirt into the dust bin 350 through a suction air passage P5, a housing, a paper slot, guide protrusions, rotary cutters, an operation button, and a dust or dirt, respectively.

As described above, according to the first to third exemplary embodiments of the present disclosure, the canister type vacuum cleaner, the upright type vacuum cleaner, and the robot cleaner combine the shredding function capable of shredding documents (bills, receipts, postal matters, etc.) with personal information with the cleaning function by installing the shredders 70, 170, 270 and 370 therein, respectively, thereby thoroughly preventing unwanted leaks of the personal information and improving the convenience in use.

Although representative embodiments of the present disclosure have been shown and described in order to exemplify the principle of the present disclosure, the present disclosure is not limited to the specific embodiments. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A vacuum cleaner comprising:

a cleaner body having a suction source to generate a suction force;

a suction nozzle assembly to draw in a dust or dirt from a surface to be cleaned by using the suction force of the suction source;

a cyclone unit to separate the dust or dirt drawn in through the suction nozzle assembly from an air;

a dust bin detachably disposed to the cleaner body to collect the dust or dirt separated at the cyclone unit; and a shredder to shred a paper, the shredder being detachably communicated with an opening of the dust bin to collect shredded paper into the dust bin, wherein the dust bin comprises an open and close part to close up the opening thereof during a vacuum cleaning and to open the opening thereof during a use of the shredder.

2. The cleaner as claimed in claim 1, wherein the open and close part comprises:

a blocking plate slidably coupled to a side of the dust bin to be led in thereinto and withdrawn therefrom; and a guide rib formed on an inner surface of the dust bin to be coupled with an end of the blocking plate thus to maintain a sealing therebetween.

3. The cleaner as claimed in claim 1, wherein the open and close part comprises:

a valve rotatably disposed on an inner side of the dust bin;

a rotary knob connected to a center of rotation of the valve and exposed to an outer side of the dust bin, to rotate the valve; and a locking protrusion and a pair of fixing protrusions to selectively lock the rotary knob, the locking protrusion being formed on an outer circumferential surface of the rotary knob and the pair of fixing protrusions being formed on the outer side of the dust bin to allow the locking protrusion to be snapped thereto.

4. The cleaner as claimed in claim 3, wherein the valve comprises a pair of wings symmetrical to the center of rotation thereof at both sides thereof, and wherein the pair of wings have seal members disposed along respective ends thereof to guarantee a sealing performance during the closing up of the opening of the dust bin.

5. A vacuum cleaner comprising:

a cleaner body having a suction source to generate a suction force;

a suction nozzle assembly to draw in a dust or dirt from a surface to be cleaned by using the suction force of the suction source;

a cyclone unit to separate the dust or dirt drawn in through the suction nozzle assembly from an air;

a dust bin detachably disposed to the cleaner body to collect the dust or dirt separated at the cyclone unit; and a shredder to shred a paper, the shredder being detachably communicated with an opening of the dust bin to collect shredded paper into the dust bin, wherein the dust bin is divided into a first chamber to collect the shredded paper discharged from the shredder and a second chamber to collect the dust or dirt discharged from the cyclone unit.

6. The cleaner as claimed in claim 5, wherein the dust bin comprises first and second outlets to discharge the shredded paper and the dust or dirt collected in the first and the second chambers, respectively, and a discharge cover simultaneously open and close up the first and the second outlets.

7. A vacuum cleaner comprising:

a cleaner body having a suction source to generate a suction force;

a suction nozzle assembly to draw in a dust or dirt from a surface to be cleaned by using the suction force of the suction source;

a cyclone unit to separate the dust or dirt drawn in through the suction nozzle assembly from an air;

a dust bin detachably disposed to the cleaner body to collect the dust or dirt separated at the cyclone unit; and a shredder to shred a paper, the shredder being detachably communicated with an opening of the dust bin to collect shredded paper into the dust bin, wherein the shredder comprises a housing having a paper slot formed thereon;

a pair of rotary cutters installed in the housing, the pair of rotary cutters being disposed parallel to be engaged with each other thus to shred the paper;

a rotary handle to rotate one of the pair of rotary cutters; and a guide installed on an inner side of the housing to guide the paper inserted through the paper slot to portions of the pair of rotary cutters, which are engaged with each other.

8. A vacuum cleaner comprising:

a cleaner body having a suction source to generate a suction force;

a suction nozzle assembly to draw in a dust or dirt from a surface to be cleaned by using the suction force of the suction source;

a cyclone unit to separate the dust or dirt drawn in through the suction nozzle assembly from an air;

a dust bin detachably disposed to the cleaner body to collect the dust or dirt separated at the cyclone unit; and a shredder to shred a paper, the shredder being detachably communicated with an opening of the dust bin to collect shredded paper into the dust bin wherein the shredder comprises a housing having a paper slot formed thereon;

a pair of rotary cutters installed in the housing, the pair of rotary cutters being disposed parallel to be engaged with each other thus to shred the paper;

a motor to rotate one of the pair of rotary cutters;

a switch installed on an outer side of the housing to turn on and off the motor; and a guide installed on an inner side of the housing to guide the paper inserted through the paper slot to portions of the pair of rotary cutters, which are engaged with each other.

9. A vacuum cleaner comprising:

a cleaner body having an intake port through which a dust or dirt is drawn in from a surface to be cleaned and which is formed on a bottom surface thereof;

an impeller rotatably disposed on a suction air path in the cleaner body to drawn in the dust or dirt from the surface to be cleaned through the intake port;

a driving motor installed outside the suction air path to drive and rotate the impeller;

a dust bin detachably disposed in the cleaner body, the dust bin being disposed in a rear of the impeller to collect the dust or dirt drawn in along the suction air path; and a shredder to shred a paper, the shredder being detachably communicated with an opening of the dust bin to collect the shredded paper into the dust bin, wherein the shredder comprises a housing having a paper slot formed thereon;

a pair of rotary cutters installed in the housing, the pair of rotary cutters being disposed parallel to be engaged with each other thus to shred the paper;

a rotary handle to rotate one of the pair of rotary cutters; and a guide installed on an inner side of the housing to guide the paper inserted through the paper slot to portions of the pair of rotary cutters, which are engaged with each other.

10. A vacuum cleaner comprising:

a cleaner body having an intake port through which a dust or dirt is drawn in from a surface to be cleaned and which is formed on a bottom surface thereof;

an impeller rotatably disposed on a suction air path in the cleaner body to drawn in the dust or dirt from the surface to be cleaned through the intake port;

a driving motor installed outside the suction air path to drive and rotate the impeller;

a dust bin detachably disposed in the cleaner body, the duct bin being disposed in a rear of the impeller to collect the dust or dirt drawn in along the suction air path; and a shredder to shred a paper, the shredder being detachably communicated with an opening of the dust bin to collect the shredded paper into the dust bin, wherein the shredder comprises a housing having a paper slot formed thereon;

a pair of rotary cutters installed in the housing, the pair of rotary cutters being disposed parallel to be engaged with each other thus to shred the paper;

a motor to rotate one of the pair of rotary cutters;

a switch installed on an outer side of the housing to turn on and off the motor; and a guide installed on an inner side of the housing to guide the paper inserted through the paper slot to portions of the pair of rotary cutters, which are engaged with each other.

11. A vacuum cleaner comprising:

a cleaner body having a suction source to generate a suction force;

a suction nozzle assembly coupled to or integrally formed with the cleaner body to draw in a dust or dirt from a surface to be cleaned by using the suction force of the suction source, a suction air path being formed from the suction nozzle assembly to the suction source;

a dust bin to collect the dust or dirt drawn into the dust or dirt through suction nozzle assembly, the dust bin being disposed on the suction air path between the suction nozzle assembly and the suction source; and a shredder to shred a paper, the shredder being detachably communicated with an opening of the dust bin to collect the shredded paper into the dust bin, wherein the dust bin comprises an open and close part to close up the opening thereof during a vacuum cleaning and to open the opening thereof during a use of the shredder.

12. A vacuum cleaner comprising:

a cleaner body having a suction source to generate a suction force;

a suction nozzle assembly coupled to or integrally formed with the cleaner body to draw in a dust or dirt from a surface to be cleaned by using the suction force of the suction source, a suction air path being formed from the suction nozzle assembly to the suction source;

a dust bin to collect the dust or dirt drawn into the dust or dirt through suction nozzle assembly, the dust bin being disposed on the suction air path between the suction nozzle assembly and the suction source; and a shredder to shred a paper, the shredder being detachably communicated with an opening of the dust bin to collect the shredded paper into the dust bin, wherein the dust bin is divided into a first chamber to collect the shredded paper discharged from the shredder and a second chamber to collect the dust or dirt discharged from the cyclone unit, and comprises first and second outlets to discharge the shredded paper and the dust or dirt collected in the first and the second chambers, respectively, and a discharge cover simultaneously open and close up the first and the second outlets.

13. The cleaner as claimed in claim 11, wherein the dust bin is disposed in a rear of the suction air path.

14. The cleaner as claimed in claim 13, wherein the suction source comprises:

an impeller rotatably disposed on the suction air path to drawn in the dust or dirt from the surface to be cleaned through an intake port; and a driving motor installed outside the suction air path to drive and rotate the impeller.

15. The cleaner as claimed in claim 13, wherein the dust bin does not include an open and close part to close up the opening thereof.

16. A vacuum cleaner comprising:

a cleaner body having an intake port through which a dust or dirt is drawn in from a surface to be cleaned and which is formed on a bottom surface thereof;

an impeller rotatably disposed on a suction air path in the cleaner body to drawn in the dust or dirt from the surface to be cleaned through the intake port;

a driving motor installed outside the suction air path to drive and rotate the impeller;

a dust bin detachably disposed in the cleaner body, the dust bin being disposed in a rear of the impeller to collect the dust or dirt drawn in along the suction air path; and a shredder to shred a paper, the shredder being detachably communicated with an opening of the dust bin to collect the shredded paper into the dust bin, wherein the dust bin comprises an open and close part to close up the opening thereof during a vacuum cleaning and to open the opening thereof during a use of the shredder.

17. A vacuum cleaner comprising:

a cleaner body having an intake port through which a dust or dirt is drawn in from a surface to be cleaned and which is formed on a bottom surface thereof;

an impeller rotatably disposed on a suction air path in the cleaner body to drawn in the dust or dirt from the surface to be cleaned through the intake port;

a driving motor installed outside the suction air path to drive and rotate the impeller;

a dust bin detachably disposed in the cleaner body, the dust bin being disposed in a rear of the impeller to collect the dust or dirt drawn in along the suction air path; and a shredder to shred a paper, the shredder being detachably communicated with an opening of the dust bin to collect the shredded paper into the dust bin, wherein the dust bin is divided into a first chamber to collect the shredded paper discharged from the shredder and a second chamber to collect the dust or dirt discharged from the cyclone unit.

* * * * *

UNITED STATES PATENT AND TRADEMARK OFFICE

CERTIFICATE OF CORRECTION

PATENT NO. : 8,522,395 B2
APPLICATION NO. : 13/362192
DATED : September 3, 2013
INVENTOR(S) : Jang-keun Oh et al.

It is certified that error appears in the above-identified patent and that said Letters Patent is hereby corrected as shown below:

In the Claims

In Column 10, Line 35, In Claim 8, delete “bin” and insert -- bin, --, therefor.
In Column 11, Line 16, In Claim 10, delete “duct” and insert -- dust --, therefor.

Signed and Sealed this
Eighteenth Day of February, 2014

Michelle K. Lee

Michelle K. Lee
*Deputy Director of the United States Patent and Trademark Office*